US008944480B2

(12) United States Patent
Nihra et al.

(10) Patent No.: US 8,944,480 B2
(45) Date of Patent: Feb. 3, 2015

(54) GOLF BALL RETRIEVER

(71) Applicants: Thomas E. Nihra, Novi, MI (US); Deni H. Nihra, Novi, MI (US)

(72) Inventors: Thomas E. Nihra, Novi, MI (US); Deni H. Nihra, Novi, MI (US)

( * ) Notice: Subject to any disclaimer, the term of this patent is extended or adjusted under 35 U.S.C. 154(b) by 0 days.

(21) Appl. No.: 13/790,738

(22) Filed: Mar. 8, 2013

(65) Prior Publication Data

US 2014/0035303 A1 Feb. 6, 2014

(51) Int. Cl.
*A63B 47/02* (2006.01)

(52) U.S. Cl.
CPC ..... *A63B 47/02* (2013.01)
USPC ..... 294/19.2; 294/210

(58) Field of Classification Search
USPC ..... 294/19.2, 16, 28, 19.3, 210; 473/286, 473/386; 56/332; D21/721
See application file for complete search history.

(56) References Cited

U.S. PATENT DOCUMENTS

| | | | | | |
|---|---|---|---|---|---|
| 1,452,679 | A | | 4/1923 | Fisher | |
| 2,205,345 | A | | 6/1940 | Charles | |
| 2,524,527 | A | | 10/1950 | Jasmer | |
| 2,538,325 | A | * | 1/1951 | Pfeiffer | 294/19.2 |
| 2,623,769 | A | | 12/1952 | Kegley, Sr. | |
| 2,658,785 | A | | 11/1953 | Llewellyn | |
| 2,924,482 | A | | 2/1960 | Gibson | |
| 2,962,321 | A | | 11/1960 | Fowler et al. | |
| 3,029,097 | A | | 4/1962 | Ward | |
| 3,038,751 | A | | 6/1962 | Stafford | |
| 3,046,044 | A | | 7/1962 | Christle | |
| 3,049,352 | A | | 8/1962 | Hancock | |
| 3,136,573 | A | | 6/1964 | Harke | |
| 3,273,927 | A | * | 9/1966 | Carlson | 294/19.2 |
| 3,306,649 | A | * | 2/1967 | Zagwyn | 294/19.2 |
| 3,547,477 | A | | 12/1970 | Young | |
| 3,770,308 | A | | 11/1973 | Faber et al. | |
| 3,887,225 | A | | 6/1975 | Mckee | |
| 4,046,413 | A | | 9/1977 | Jeninga | |
| 4,136,901 | A | | 1/1979 | Walter | |
| 4,493,503 | A | | 1/1985 | Jeninga | |
| 4,746,156 | A | | 5/1988 | Kremer | |
| 4,783,926 | A | | 11/1988 | Mckinney et al. | |
| D306,058 | S | | 2/1990 | Blake | |
| 5,184,859 | A | * | 2/1993 | Nihra et al. | 294/19.2 |
| 5,265,926 | A | | 11/1993 | Dinardo | |
| D349,739 | S | | 8/1994 | Kahl, Jr. | |
| 5,423,584 | A | * | 6/1995 | Pasternak | 294/19.2 |
| 5,437,487 | A | | 8/1995 | Fulop | |
| 5,908,214 | A | | 6/1999 | Dinardo | |
| D479,650 | S | | 9/2003 | Kan | |
| 6,824,179 | B1 | | 11/2004 | Shelato | |
| 6,962,536 | B2 | | 11/2005 | Hall et al. | |
| D592,725 | S | | 5/2009 | Trudeau | |
| 2006/0229145 | A1 | | 10/2006 | Dempsey | |

(Continued)

*Primary Examiner* — Paul T Chin
(74) *Attorney, Agent, or Firm* — Waters & Oppenhuizen PLC; David L. Oppenhuizen

(57) ABSTRACT

A device for retrieving an object such as a golf ball. In one preferred embodiment, the device comprises a handle, a stationary member or loop that is rigidly attached to the handle, a reactive member or loop that is pivotally attached to the stationary member and a spring for biasing the reactive member substantially perpendicular to the stationary member. Prior to capturing the object, the retriever is set such that the stationary and reactive members are substantially parallel. The retriever is then directed so that when the spring contacts an object, it trips the spring and causes the reactive member to pivot into a substantially perpendicular position with respect to the stationary member, capturing the object inside the stationary and reactive members.

12 Claims, 3 Drawing Sheets

(56) References Cited

U.S. PATENT DOCUMENTS

2008/0096685 A1 4/2008 Dempsey
2013/0072318 A1 3/2013 Brewer
2014/0138967 A1* 5/2014 Miller ..... 294/19.2

* cited by examiner

FIG. 1
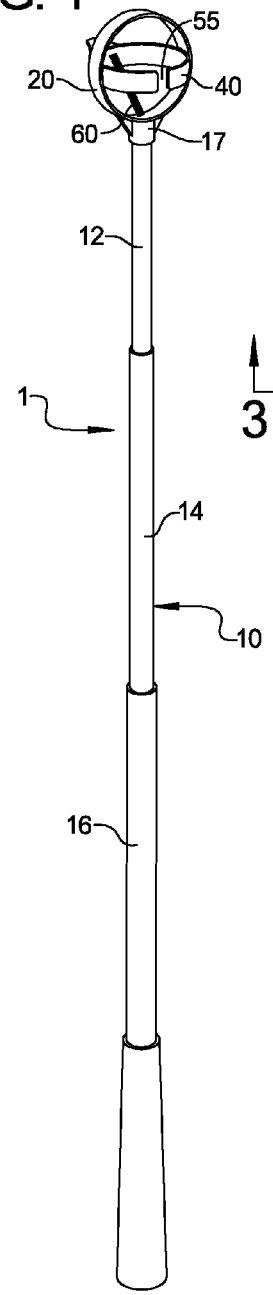
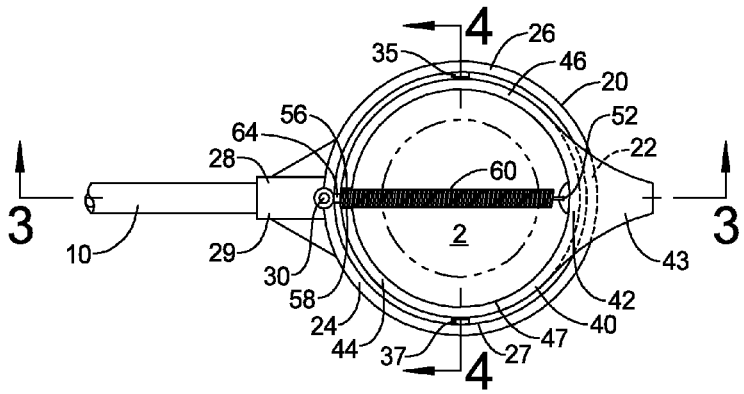
FIG. 2
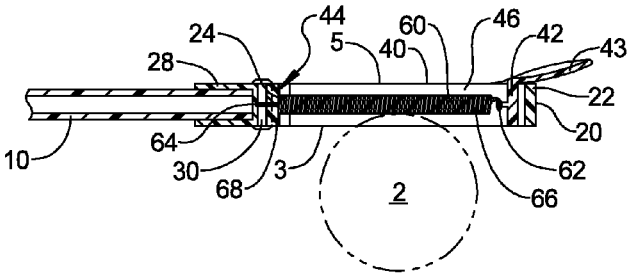
FIG. 3

GOLF BALL RETRIEVER

BACKGROUND OF THE INVENTION

1. Field of the Invention

The present invention relates to a device for retrieving objects such as golf balls.

2. Description of the Prior Art

Devices for retrieving golf balls are well known. Examples of such retrievers being scoops or single loop devices for capturing a golf ball, U.S. Pat. No. 2,524,527, a pair of loops for clamping around the ball, U.S. Pat. Nos. 1,452,679, 2,205,345, 3,887,225, 4,046,413 and 4,746,156, and a pair of loops and a bar for capturing the ball, U.S. Pat. Nos. 3,029,097 and 4,046,413, the disclosures of which are incorporated in their entirety by reference herein.

A well designed golf ball retriever should be simple to operate and have a high rate of success in capturing the ball, whether the ball is in water, mud, sand, tall grass, foliage or the cup. The retriever should also be light weight, compact and have as few parts as possible to reduce costs and increase its useful life.

A common problem with known retrievers is that they are difficult to operate and do not successfully capture and retrieve balls from a variety of environments. This problem is particularly prevalent when a ball is submerged in water. Mud and underwater plants can increase the difficulty in capturing the ball, and once captured, the viscosity of the water tends to push the ball out of the retriever when moved through the water.

U.S. Pat. No. 5,265,926 to DiNardo also discloses a golf ball retriever that is similar to the retriever disclosed herein. DiNardo discloses a retriever having a pair of concentric loops, the inner loop being pivotable with respect to the fixed outer loop. The DiNardo retriever utilizes a unique "spring-action" trap for securing the ball. However, this spring-action can be somewhat temperamental in use. The retriever is most often used to retrieve balls that are in the water, in which case the ball is often surrounded by soft and mushy vegetation or substrate. Therefore, it is desirable that the spring-action is easily sprung because there is simply nothing firm to press the ball against to release the trap. This can often result in pressing the ball deeper into the vegetation.

Conversely, the trap must be reset if it has been sprung but it did not successfully entrap the ball. To do so, the user must pull the retriever out of the water, manually reset the trap by hand, and then attempt to retrieve the ball again. Thus, there is a fine line between having a trap which is easily sprung, and having one which is released too easily. DiNardo attempts to overcome this by providing "jaws" in the inner loop which partially engage the spring in an attempt to provide the optimal amount of force necessary to spring the trap. However, this does not sufficiently help the user because in some circumstances the jaws may provide too much resistance, and they do nothing to keep the user from having to manually resetting the trap by hand.

The present invention solves these and other problems with prior art retrievers by providing a reset tab allowing the trap in the DiNardo retriever to be easily and quickly reset without having to pull the entire retriever from the water and manually reset the trap by hand.

SUMMARY OF THE INVENTION

The present invention is a device for retrieving an object such as a golf ball. In a first preferred embodiment, the retriever comprises a handle, a stationary loop rigidly attached to the handle, a reactive loop pivotally attached to the stationary loop, the reactive loop including an offset tab that extends beyond the stationary loop; and means for biasing the reactive loop substantially perpendicular to the stationary loop, each of the loops substantially surrounding the object when positioned substantially perpendicular to each other. The biasing means is preferably a spring positioned inside the reactive member.

The stationary loop and reactive loop each have top, bottom and side portions. The bottom portion of the stationary loop is attached to the handle and the side portions of the reactive loop are pivotally attached to the side portions of the stationary loop. The offset tab extends from the top portion of the reactive loop.

Prior to capturing the object, the retriever is set so that the stationary and reactive members are substantially parallel. An operator then directs the retriever so that the spring contacts the object. This trips the spring and causes the reactive member to pivot into a substantially perpendicular position with respect to the stationary member—the object being captured inside the stationary and reactive members.

One advantage of the present invention is its ease of operation. The retriever is easily set, and once set, the operator need only direct the spring toward the object. This ease of operation result in a high success rate in capturing objects such as golf balls, even when the object is submerged in water. In addition, if the retriever needs to be reset while in use, the operator can easily reset the retriever by turning the retriever over, and leveraging the offset tab against a resistive object (such as a log or a rock) to pull the reactive loop back to the "set" position that is parallel with the stationary loop.

Another advantage of the present invention is that the object is enclosed or captured inside or between the stationary and reactive members. The object will not fall out if the retriever is rotated or shaken. Thus, the viscous forces of water will not push the ball out of the retriever when it is moved through the water.

A further advantage of the present invention is its simple construction and few parts which make it economical to consumers. The retriever is also compact and light weight.

A still further advantage of the present invention is that even if the retriever is inadvertently tripped, or sprung, before capturing an object, it can still be used to retrieve an object such as a golf ball, even when the ball is resting on soft mud, sand or underwater foliage. But as described above, the retriever can easily be reset remotely without having to pull the retriever back and do so by hand.

For a more complete understanding of the present invention, reference is made to the following detailed description and accompanying drawings. In the drawings, like reference characters refer to like parts throughout the views in which:

BRIEF DESCRIPTION OF THE DRAWINGS

FIG. 1 is a plan view of the retriever with a telescoping handle;

FIG. 2 is a top plan view of the ball retriever in its set position and positioned over a golf ball shown in phantom;

FIG. 3 is a cross-sectional view taken along the lines 3-3 of FIG. 2 and showing a side view of the retriever in its set position with the spring engaging a golf ball shown in phantom lines;

DETAILED DESCRIPTION OF THE PREFERRED EMBODIMENT

Figure 4:
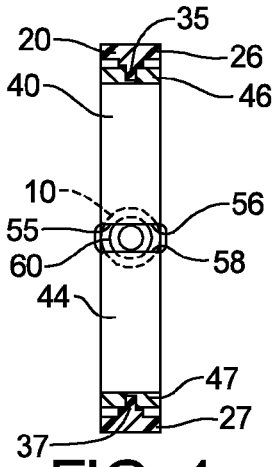
FIG. 4 is a cross-sectional view shown taken along the lines 4-4 of FIG. 2 showing the retriever in its set position.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

As shown in FIG. 1, the present invention is a device for retrieving objects such as golf balls and is shown generally by reference number 1. The retriever 1 generally comprises a handle 10, a stationary loop or member 20, a reactive loop or member 40 and a means for biasing the reactive member to pivot into a preferable substantially perpendicular position with respect to the stationary member. Although the figures show reactive and stationary members 20 and 40 as circular loops for facilitating the capture of a spherical object such as a golf ball 2, it should be understood that these members could be shaped in many different ways to facilitate the capture of a variety of differently shaped objects. It should be noted that handle 10 and loops 20 and 40 are preferably made of a light weight, rigid material, such as aluminum or plastic.

As shown in FIG. 1, handle 10 is preferably a telescoping handle made of several tubes 12, 14 and 16, each tube fitting inside the other with a fit that will permit telescoping and yet snug enough to remain extended. However, it should be understood that other types of handles could be implemented. Tubes 12, 14 and 16 are preferably hollow with open end 17 being secured to stationary member 20.

As shown in FIGS. 2-4, stationary member 20 can take the form of a loop having a top 22, a bottom 24, and two side portions 26 and 27. Bottom portion 24 of stationary loop 20 preferably has tabs 28 and 29 which conform to the shape of and are rigidly attached to the end 17 of handle 10.

A pin 30 or similar fastener may be used to rigidly secure stationary loop 20 to handle 10. This is done by forming holes in tabs 28 and 29 and handle end 17. Pin 30 is inserted through these holes and its ends are riveted or flattened to keep it from falling out and to ensure that tabs 28 and 29 fit snugly against handle 10.

Pivot pins 35 and 37 are preferably inserted into the side portions 26 and 27 of stationary loop 20 to facilitate the pivotal attachment of reactive member 40 within the stationary loop 20. Pivot pins 35 and 37 are preferably spaced 180° apart. As illustrated, they are spaced 90° from pin 30.

Reactive member 40 is also shown in the form of a loop and has a top 42, a bottom 44, and two side portions 46 and 47. For ease of construction and compactness, reactive loop 40 is preferably sized to fit inside stationary loop 20. However, it should be understood that reactive loop 40 could be adapted to fit outside stationary loop 20. Side portions 46 and 47 have holes for receiving pivot pins 35 and 37. In this way, pivot pins 35 and 37 pivotally attach reactive or pivoting loop 40 to stationary loop 20. Hole 52 is preferably provided in the top portion 42 of reactive loop 40 for facilitating the attachment of the end of a biasing spring 60 which serves to bias reactive loop 40 into a perpendicular position with respect to stationary loop 20.

It should be understood that other biasing means may be used. In the preferred embodiment, spring 60 is a cylindrical helical spring with hooks 62 and 64 at each of its two ends 66 and 68. Hooks 62 and 64 are formed by bending the outer helical loops of spring 60 perpendicular to the cylindrical spring. One end 66 of spring 60 is preferably attached to the top portion 42 of reactive loop 40 by passing hook 62 through hole 52. The other end 68 of spring 60 is preferably attached to handle 10 by looping hook 64 around pin 30. Clips may also be used to attach the ends 66 and 68 of spring 60 to the top portion 42 of reactive loop 40 and pin 30. One end 66 of spring 60 is preferably attached opposite pin 30 or 180° around loop 40, but the retriever 1 will also operate if attached only 160° from pin 30.

The reactive member 40 also has an offset tab 43 that is connected to, and extends outwardly from the top portion 42. The offset tab 43 is preferably formed integrally with the reactive member 40, although it can be a separate piece that is secured thereto using fasteners, an adhesive, or the like. The offset tab 43 extends beyond the stationary loop 20 and is offset to the side 5 to pass around and by the loop 20.

To operate the retriever 1, reactive loop 40 is set substantially parallel to stationary loop 20. (See FIGS. 2-4). In this set position, spring 60 is stretched and exerts a force on reactive loop 40. Because spring 60 is substantially parallel to loops 20 and 40 when in this set position, the force exerted by spring 60 on reactive loop 40 is equal toward both sides 3 and 5, and therefore the reactive loop 40 remains in its set position inside the stationary loop 20.

As shown in FIGS. 1-4, the bottom portion 42 of reactive loop 40 is preferably notched to accommodate spring 60 when in the set position. Optionally, the notch 55 has jaws 56 and 58 that are spaced apart less than one diameter of spring 60. Therefore, jaws 56 and 58 frictionally engage spring 60 in the set position. This frictional contact helps prevent the retriever 1 from inadvertently triggering while an operator is directing the retriever towards the object. The frictional engagement does not substantially inhibit the object from dislodging or triggering spring 60 to rotate the reactive loop 40 inside the stationary loop 20.

When an object contacts and pushes against spring 60, spring 60 and reactive loop 40 pivot slightly out of parallel with stationary loop 20. The top portion 42 of the loop 40 rotates away from the object and this misalignment causes the spring 60 to apply a greater lateral force against 5. The misalignment of forces creates a torque about the pins 35 and 37 that causes the top portion 42 of the reactive loop 40 to rotate and accelerate toward the spring 60 which rapidly returns to its relaxed position, thereby capturing the object to be retrieved.

Figure 5:
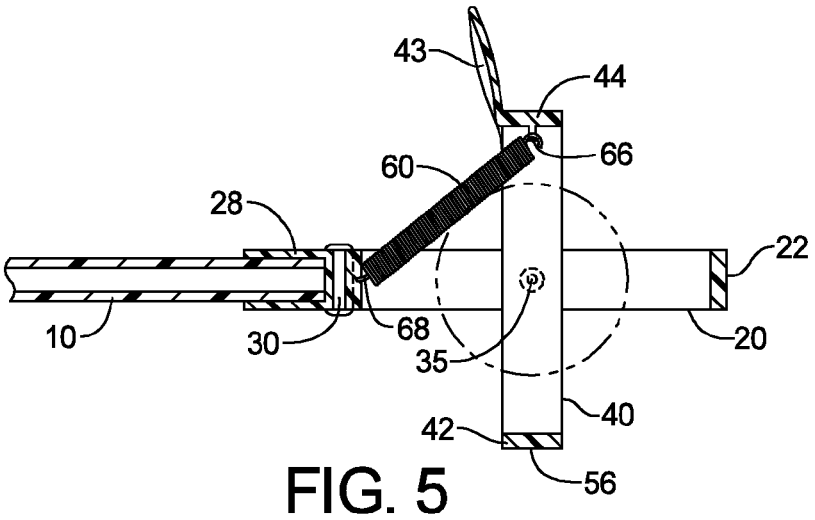
FIG. 5 is a cut-away view of the side of the retriever in its perpendicular position after capturing the golf ball.
Figure 6:
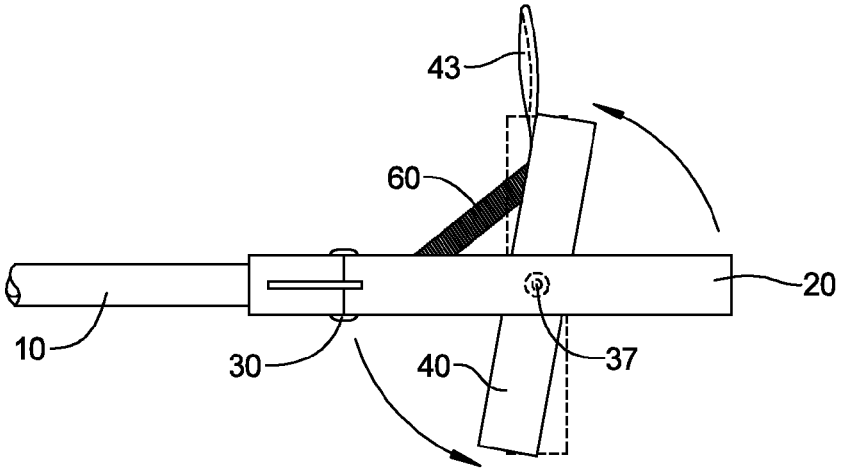
FIG. 6 is a side plan view of the retriever showing the spring recoiling when retrieving an object.

As shown in FIGS. 5 and 6, spring 60 is sized so that in its relaxed position, reactive loop 40 is substantially perpendicular to stationary loop 20. The perpendicular orientation is preferred because it minimizes the gap between the top portions 22 and 42 of loops 20 and 40. The smaller this gap is, the less likely an object such as golf ball 2 will escape.

Figure 7:
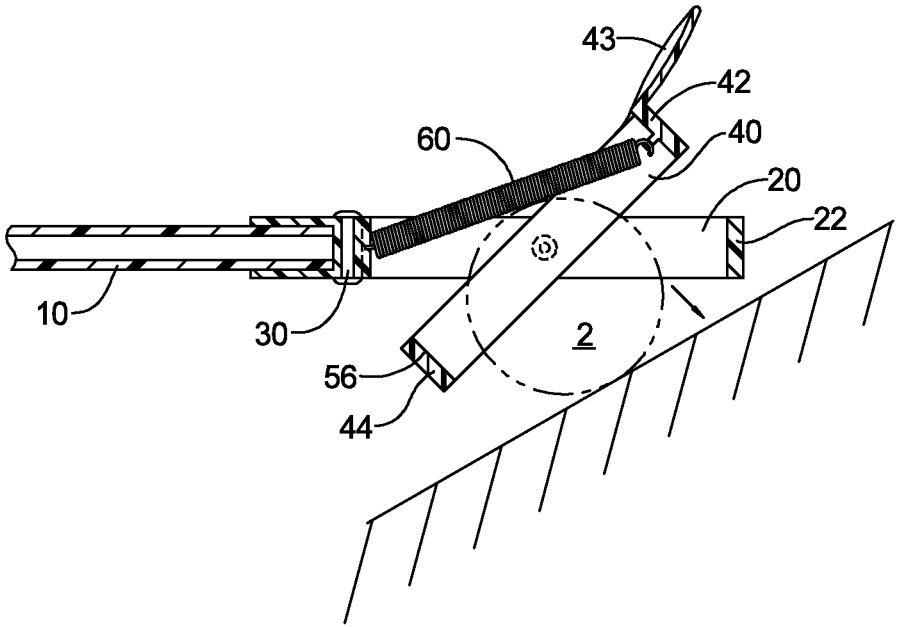
FIG. 7 is a plan view of the retriever showing a golf ball being forced between the stationary and reactive members.

As shown in FIG. 7, the retriever 1 may be used to capture an object even after spring 60 has been tripped and reactive loop 40 is in its perpendicular position. This is done by positioning the object such as golf ball 2 between stationary member 20 and reactive member 40, and pushing it against reactive member 40. This causes reactive member 40 to pivot and the gap between the top portions 22 and 42 of loops 20 and 40 to increase, thereby allowing the object to fit between loops 20 and 40. Once inside, reactive loop 40 returns to its perpendicular position.

Figure 8:
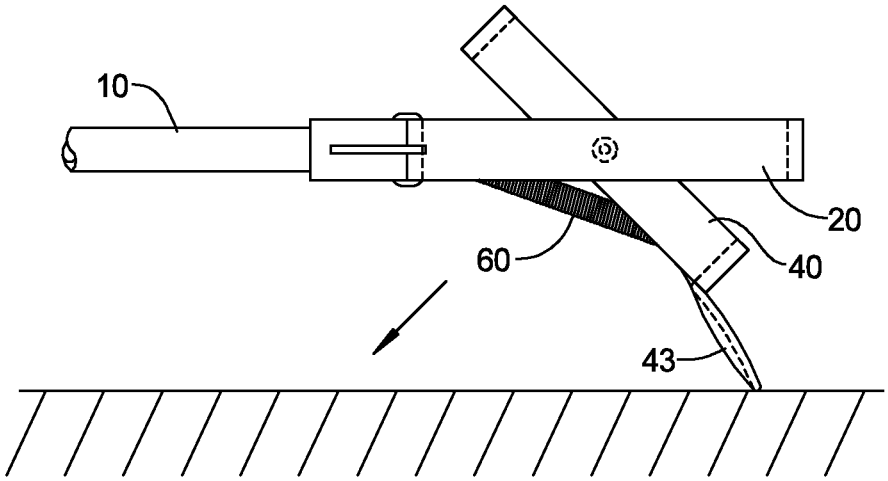
FIG. 8 is a side plan view showing the retriever being reset by applying the offset tab against a resistive object, such as the ground.

When the ball 2 is surrounded by material that is not firm, such as vegetation, sand, or other organic muck found underwater, the material will not provide the requisite resistant force to allow the user to retrieve the ball after the retriever 1 has been tripped, or sprung, such as described above and shown in FIG. 7. Retrieving the ball 2 in this manner can simply result in the ball 2 being pressed deeper into the soft material. In this instance, and as shown in FIG. 8, the retriever 1 can be reset by turning (or flipping) it over, or rotating it 180°, and then pulling the retriever 1 toward the operator while pressing downward onto an object (such as a rock, a log, the ground, etc.) so that the offset tab 43 catches onto the material and provides a leverage point for rotating the reactive member 40 back into a parallel position with the stationary member 20. The operator can then turn the retriever 1 back over again and retrieve the ball 2.

The stiffness of spring 60 is important. The stiffness of spring 60 defines its resistance to stretching or bending, and the forces it will exert on reactive loop 40. The force of the spring is important for successfully capturing the object from soft mud, tall grass, foliage, etc., and preventing the object from escaping.

As mentioned above, when spring 60 is triggered, it causes reactive member 40 to rotationally accelerate about pins 35 and 37. The angular momentum of reactive loop 40 tends to cause it to rotate beyond the desired perpendicular position. This in turn, causes spring 60 to bend inwardly upon itself. Because spring 60 is preferably a cylindrical helical spring of predetermined length and diameter, it resists this inward bending and causes loop 40 to quickly come to rest in the desired perpendicular position. Stationary loop 20 and reactive loop 40 also have predetermined dimensions that depend on the size and shape of the object being captured. Loops 20 and 40 should be sized to provide the largest area possible for capturing the object, but must also ensure that the object will not fall out once captured.

When the object being retrieved is a standard size golf ball 2, spring 60 preferably has a relaxed cylindrical length of 1⅞ inches, a diameter of 3/16 inch, and a stiffness of 0.22 lbs. initial tension. Stationary and reactive loops 20 and 40 are preferably circular in shape, loop 20 having a diameter of about 2 inches and loop 40 having a diameter of about 1¾ inches. Loops 20 and 40 are also preferably 5/16 to ½ inch wide and 0.07 to 0.10 inch thick. However, it should be understood that the above dimensions can vary without rendering the retriever 1 inoperable.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A device for retrieving an object comprising:

a handle;

a stationary loop rigidly attached to said handle;

a reactive loop pivotally attached to said stationary loop, said reactive loop including a ground-engaging offset tab, the stationary loop and the reactive loop each having a top, bottom, and side portions, the bottom portion of the stationary loop is attached to the handle, the side portions of the reactive loop are pivotally attached to the side portions of the stationary loop, and the offset tab extends from the top portion of the reactive loop, the offset tab extending in a direction away from the handle when the stationary loop and the reactive loop are oriented parallel to each other; and means for biasing said reactive loop substantially perpendicular to said stationary loop, each of said loops substantially surrounding the object when positioned substantially perpendicular to each other.

2. The device of claim 1, wherein said reactive loop is positioned inside said stationary loop and is adapted to rotate relative thereto in response to said biasing means.

3. The device of claim 2 wherein the ground-engaging offset tab extends from a side of the top portion of the reactive loop and extends around and past the stationary loop when the stationary and reactive loops are oriented parallel to each other.

4. The device of claim 1, wherein said biasing means is a spring.

5. The device of claim 4, wherein said spring is a cylindrical helical spring having two ends, one end being attached to said top portion of said reactive loop and said other end being attached to said handle.

6. The device of claim 5, wherein said bottom portion of said reactive loop is notched and said spring passes through said notch.

7. The device of claim 6, wherein said spring has a diameter of about 3/16 inch and a stiffness of about 0.22 lbs., and said stationary and reactive loops are substantially circular in shape with diameters of about 2 and 1¾ inches respectively.

8. The device of claim 1, wherein said handle is a telescoping handle.

9. The device of claim 1 wherein the ground-engaging offset tab extends from a side of the top portion of the reactive loop and extends around and past the stationary loop when the stationary and reactive loops are oriented parallel to each other.

10. A device for retrieving objects comprising:

a telescoping handle;

a stationary loop attached to said handle, said stationary loop having top, bottom and side portions;

a reactive loop positioned inside said stationary loop and having top, bottom and side portions, said side portions of said reactive loop being pivotally attached to said side portions of said stationary loop, and including an offset tab that extends from the top portion of the reactive loop beyond the stationary loop and in a direction opposite the bottom portions of the reactive and stationary loops when the reactive and stationary loops are oriented parallel to each other; and a spring for biasing said reactive loop substantially perpendicular to said stationary loop, each of said loops substantially surrounding the object when positioned substantially perpendicular to each other, said spring having two ends, one end being attached to said top portion of said reactive loop and said other end being attached to said handle.

11. The device of claim 10, wherein said bottom portion of said reactive loop is notched, said spring passing through said notch.

12. The device of claim 10 wherein the offset tab extends from a side of the top portion of the reactive loop and extends around and past the stationary loop when the stationary and reactive loops are oriented parallel to each other.

* * * * *